US006114706A

United States Patent [19]

Meikle et al.

[11] Patent Number: 6,114,706

[45] **Date of Patent: *Sep. 5, 2000**

[54] METHOD AND APPARATUS FOR PREDICTING PROCESS CHARACTERISTICS OF POLYURETHANE PADS

[75] Inventors: Scott G. Meikle; Guy F. Hudson, both of Boise, Id.

[73] Assignee: Micron Technology, Inc., Boise, Id.

[ * ] Notice: This patent is subject to a terminal disclaimer.

[21] Appl. No.: 08/914,994

[22] Filed: Aug. 20, 1997

Related U.S. Application Data

[62] Division of application No. 08/386,023, Feb. 9, 1995, Pat. No. 5,698,455.

[51] Int. Cl.[7] ..... G01N 21/64

[52] U.S. Cl. ..... 250/461.1; 250/458.1

[58] Field of Search ..... 250/461.1, 459.1, 250/458.1

[56] References Cited

U.S. PATENT DOCUMENTS 5,256,880 10/1993 Loree et al. ..... 250/461.1

5,698,455 12/1997 Meikle et al. ..... 437/8

*Primary Examiner*—Seungsook Ham

*Assistant Examiner*—Richard Hanig

*Attorney, Agent, or Firm*—Dorsey & Whitney LLP

[57] ABSTRACT

A measurement of polyurethane pad characteristics is used to predict performance characteristics of polyurethane pads used for chemical mechanical planarization (CMP) of semiconductor wafers, and to adjust process parameters for manufacturing polyurethane pads. In-situ fluorescence measurements of a pad that has been exposed to a high pH and high temperature environment are performed. The fluorescence characteristics of the pad are used to predict the rate of planarization of a wafer. A portion of one pad from a manufacturing lot is soaked in an organic solvent which causes the portion to swell. The relative increase in size is indicative of the performance characteristics of pads within the manufacturing lot. Statistical Process Control methods are used to optimize the CMP pad manufacturing process. Predicted pad characteristics are available for each pad.

11 Claims, 4 Drawing Sheets

METHOD AND APPARATUS FOR PREDICTING PROCESS CHARACTERISTICS OF POLYURETHANE PADS

CROSS-REFERENCE TO RELATED APPLICATION

This application is division of U.S. patent application Ser. No. 08/386,023, filed Feb. 9, 1995 (U.S. Pat. No. 5,698, 455).

FIELD OF THE INVENTION

This invention relates to the use of chemical mechanical planarization (CMP) in the manufacture of semiconductor integrated circuits and more particularly to prediction of performance characteristics of polyurethane pads used for CMP of semiconductor wafers.

BACKGROUND OF THE INVENTION

During fabrication of integrated circuits, it is often desirable to planarize and/or polish the surface of a semiconductor wafer. One method of performing these tasks is referred to as chemical mechanical planarization (CMP). In general, the CNT process involves rotation or random movement of a wafer on a polishing pad in the presence of a polishing slurry. The polishing pad is typically formed of a polyurethane material.

Downward pressure on the wafer against the pad, rotational speed of the wafer and the pad, slurry content and pad characteristics determine the rate at which material is removed from the surface of the wafer, and the uniformity of the resulting wafer surface.

Determination of how long a wafer should be planarized or polished has proven to be a difficult task An apparatus and method for in-situ measurement of the thickness of a material to be planarized for CMP end point determination is described in U.S. Pat. No. Re. 34,425 to Schultz.

Methods of controlling the pressure exerted on the wafer against the pad, rotational speed or random- movement of the wafer on the pad and slurry composition are well known in the art. Condition and performance characteristics of the polyurethane pad are more difficult to determine. The ability of a pad to planarize the surface of a wafer varies substantially from pad to pad and over the life of an individual pad.

After a wafer has been through the CMP process the pad will be conditioned to prepare it for another wafer. The conditioning process comprises a controlled abrasion of the polishing pad surface for the purpose of retuning the pad to a state where it can sustain polishing. The ability of the conditioning process to return the pad to a state where it can efficiently planarize an additional wafer is dependent upon the pad itself and the conditioning parameters. After planarizing several hundred wafers, the pad may no longer be useful for planarizing wafers despite the conditioning process.

The ability to predict performance characteristics of new and used polyurethane pads would be a great benefit to users and manufacturers of such pads.

SUMMARY OF THE INVENTION

A measurement of chemical bonding of polymer chains within a polyurethane pad manufactured for chemical mechanical planarization (CMP) of semiconductor wafers is used to predict performance characteristics of the pad, and to adjust process parameters for the subsequent manufacture of additional polyurethane pads.

After manufacturing a lot, one pad or a portion of a pad from the manufacturing lot is soaked in an organic solvent which causes the pad material to swell. It is believed that the relative increase in size is indicative of chemical bonding of polymer chains within the pad. The increase in pad size is indicative of the performance characteristics of the pad. Statistical Process Control methods are used to optimize the pad manufacturing process. A manufacturing lot may consist of any number of pads which are deemed to have been manufactured under conditions which tend to cause all pads within the lot to have very similar performance characteristics. Measurements of pad performance predictors allow predicted pad characteristics to be available for each pad. The predicted performance characteristics may be used as a measure of quality of the pad, and may also be provided to pad end users.

Pad characteristic measurements may be taken before any wafers are planarized. Measurements may also be taken after each wafer is planarized or at intervals throughout the life of the pad. Repeated use of the pad impacts the polishing/planarizing ability of the pad. During the CNP process, polyurethane pads are often exposed to high pH (9.0 to 13.0) and high temperature (0 to 90 C.) environments. A correlation between fluorescence characteristics and pad performance has been noted in pads that have been exposed to such conditions. In order to predict future performance of a used pad, in-situ fluorescence measurements of the pad are performed. The fluorescence characteristics of the pad are also believed to be indicative of the chemical bonding of polymer chains within the pad, and are used to predict the effect conditioning will have on the pad. The predicted effect of conditioning is then used to predict performance characteristics of the pad. The measurement of pad fluorescence characteristics also allows for worn or substandard pads to be replaced prior to wafer processing.

BRIEF DESCRIPTION OF THE DRAWINGS

The features of the invention as well as objects and advantages will be best understood by reference to the appended claims, detailed description of particular embodiments and accompanying drawings where:

DETAILED DESCRIPTION OF THE PREFERRED EMBODIMENTS

Figure 1:
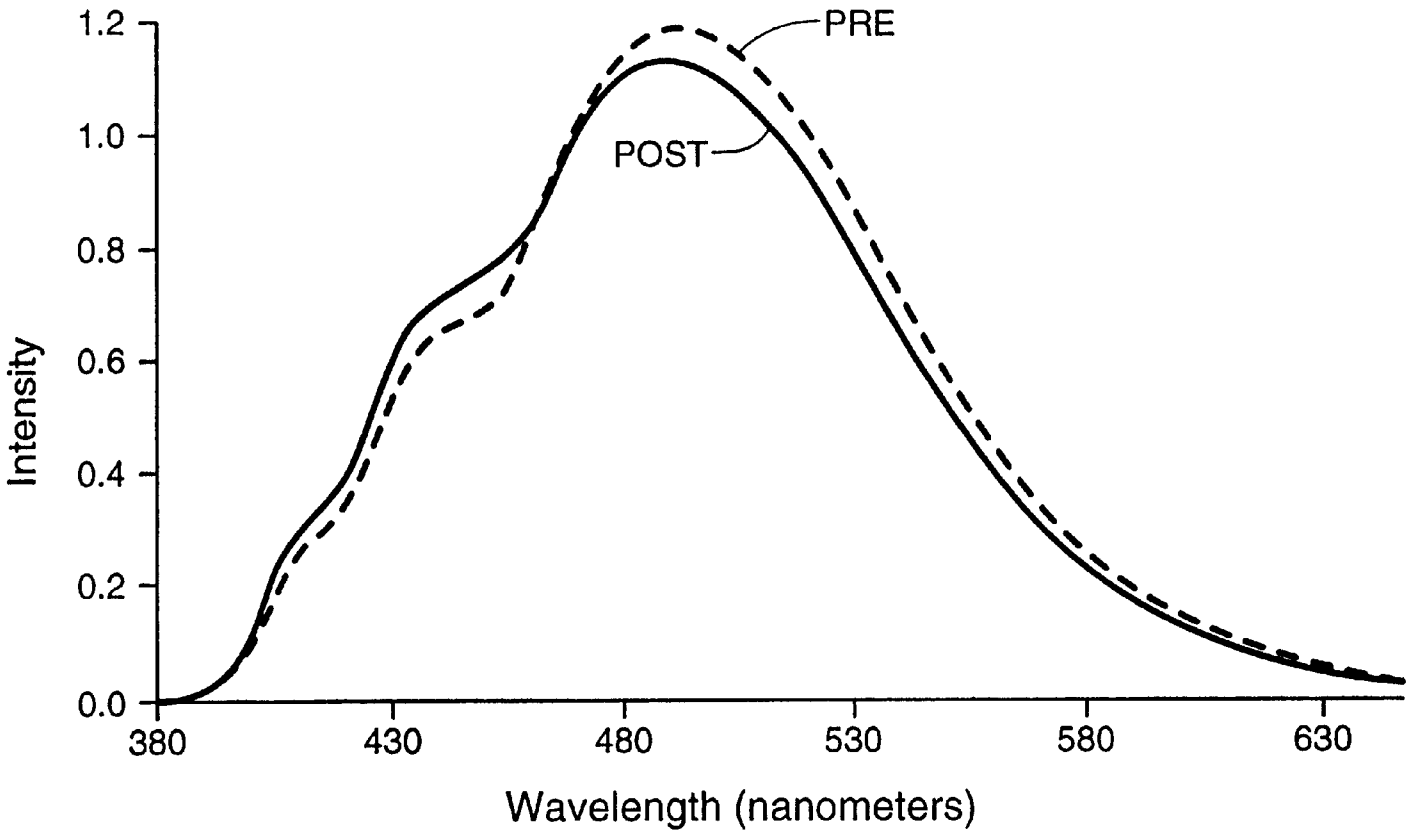
FIG. 1 is a plot of fluorescence wavelength versus intensity for a CMP pad.

FIG. 1 shows the fluorescence properties of a typical polyurethane CMP pad before (PRE) and after (POST) a five hour exposure to a pH 10.5 solution at a temperature of 60 C. After exposure, there is a shift in the spectra to shorter wavelengths. The amount of shift varies from pad to pad. Two characteristic intensity peaks are noted in the spectra. One at approximately 436 nanometers and a second maximum peak at a wavelength which varies from pad to pad. In a preferred embodiment of the invention, a pad is exposed to the high pH and high temperature environment prior to making the fluorescence measurement so that the measurement is made after the characteristic shift in wavelengths.

Figure 2:
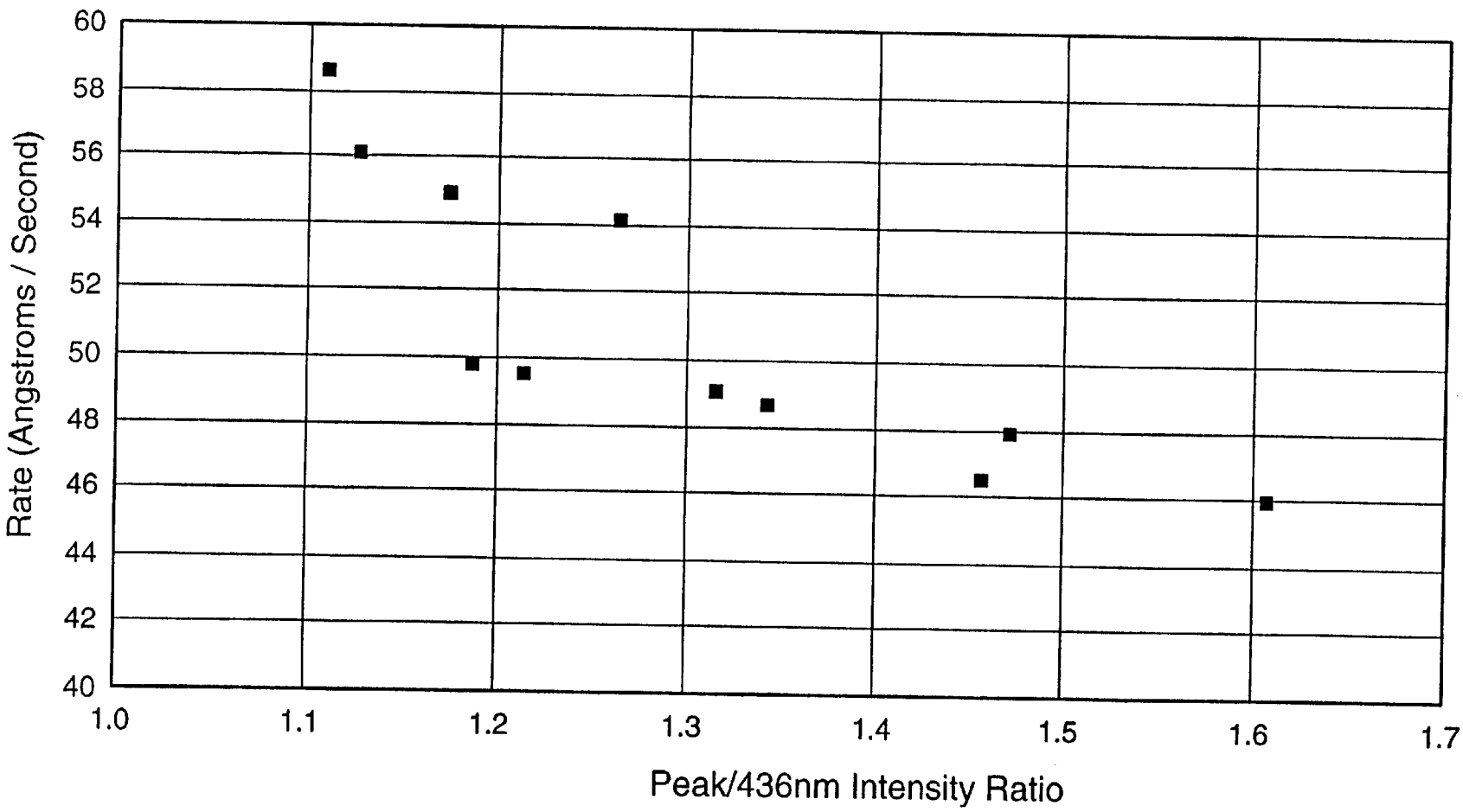
FIG. 2 is a plot of fluorescence wavelength peak divided by 436 nanometers versus wafer material removal rate of a CMP pad.

FIG. 2 shows a plot of maximum fluorescence intensity divided by the intensity at 436 nanometers versus the planarization rate of a semiconductor device wafer. This plot shows a relationship between the fluorescence characteristics of the CMP pad and the pad's ability to planarize a semiconductor wafer. The planarizing rate is also related to the process stability, defect density and uniformity of the processed wafer. Knowledge of the performance characteristics of the pad allows for substandard pads to be rejected prior to use, this in turn reduces the amount of wafer material needed to be scrapped.

Figure 3:
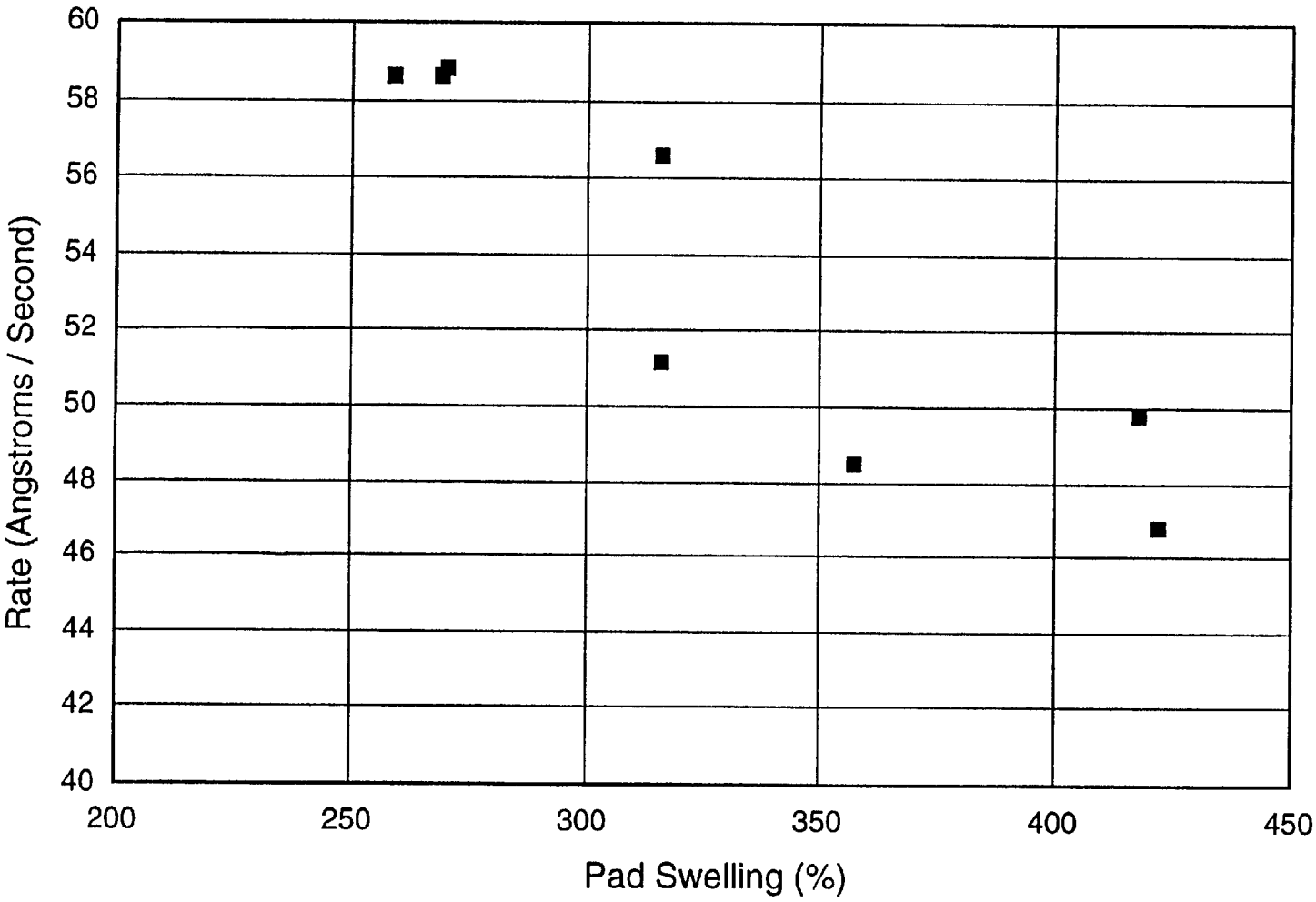
FIG. 3 is a plot of pad swelling versus wafer material removal rate.

FIG. 3 is a plot of the swelling of a portion of a CNP pad soaked in N-Methyl-2-pyrrolidone (NMP) for twenty-four hours versus the rate of planarization of a semiconductor device wafer which is planarized by the pad. Increases in swelling beyond twenty-four hours are not very large; however, longer or shorter periods of time may be used. The swelling measurement shown is a measurement of increase in pad area. The increase in pad volume, or simply the increase in length of a strip of pad material may also be used. Greater swelling indicates that the planarization rate will be lower. It is believed that other organic solvents such as MEK, MIBK, THF, Xylene and MeCl2 may be used with similar results.

The plots of FIGS. 1, 2 and 3 show that measurements of polyurethane pad characteristics can be used to predict the planarization characteristics of the pad. The predicted planarization characteristics allow for a determination of planarization time in a CMP process. Predicted planarization characteristics of a CMP pad can also be used for process control and quality control in the manufacture of CMP pads. This data may be sent with the pads to CMP pad customers in the form of predicted planarization characteristics for particular CMP processes. The inventive method of measuring pad characteristics may be used to perform incoming inspection on the pads. Substandard pads can be rejected before they are ever used.

Figure 4:
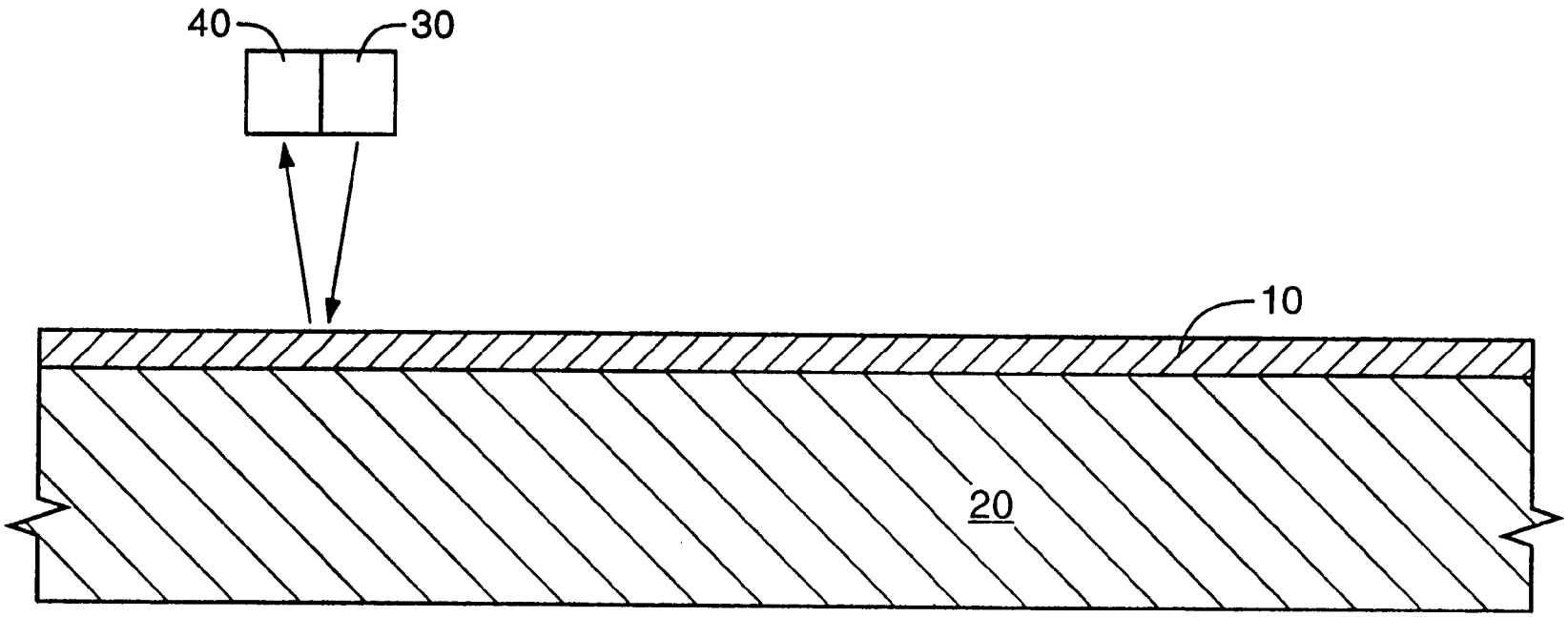
FIG. 4 is a diagram of an apparatus for in-situ measurement of the fluorescence characteristics a CMP pad.

FIG. 4 shows an in-situ method of measuring fluorescence characteristics of CMP pads in a CMP apparatus. A pad 10 is secured to a platen 20 which is rotateable. A radiation source 30 is secured above the pad surface. The radiation source may be a source of ultraviolet light which is directed at the pad. The wavelength of the source is preferably below 350 nanometers. Prior to and/or after conditioning, the radiation source is used to cause the pad to fluoresce. An electromagnetic radiation detection device, or photodetector, 40 is mounted above the pad surface. Emission from the pad is typically in the range of 200 nanometers to 800 nanometers.

A measure of intensity versus wavelength of electromagnetic radiation is used to determine when the pad should be replaced, and how the pad will perform when processing wafers. This prediction of pad performance is used to adjust the CMP process variables in order to achieve consistent CMP results with fewer end point detection measurement requirements.

While the present invention has been described with reference to specific preferred embodiments, alternate embodiments and modifications may be employed by persons skilled in the art without departing from the scope of the invention as defined by the following claims.

What is claimed is:

1. An apparatus for chemical mechanical planarization of a wafer, comprising:

a polishing platen for securing a pad; and a measuring apparatus to measure chemical bonding of polymer chains within the pad while the pad is secured to said polishing platen.

2. The apparatus according to claim 1, wherein;

said measuring apparatus comprises a means for measuring a fluorescence characteristic of the pad.

3. The apparatus according to claim 2, wherein;

said measuring apparatus further comprises an ultraviolet light source.

4. An apparatus for predicting performance characteristics of a polymeric pad for use in chemical mechanical planarization comprising:

a radiation source for irradiating the polymeric pad; and an electromagnetic radiation detection device for measuring emission radiation from the polymeric pad, the emission radiation being a function of a performance characteristic of the polymeric pad.

5. The apparatus according to claim 4, wherein said radiation source is an ultraviolet light source.

6. The apparatus according to claim 4, wherein electromagnetic radiation detection device is a photodetector.

7. An apparatus for chemical mechanical polishing of a wafer, comprising:

an attachment means for securing a pad; and a measurement means to measure chemical bonding of polymer chains within the pad while the pad is secured by said attachment means.

8. The apparatus according to claim 7, wherein;

said attachment means is a polishing platen.

9. The apparatus according to claim 7, wherein;

said measurement means is further comprised of a radiation source and an electromagnetic detection device.

10. The apparatus according to claim 9, wherein;

said radiation source is an ultraviolet light source.

11. The apparatus according to claim 9, wherein;

said electromagnetic detection device is a photodetector.

* * * * *